US012325943B2

(12) United States Patent
Stieger

(10) Patent No.: US 12,325,943 B2
(45) Date of Patent: Jun. 10, 2025

(54) EMBROIDERY FRAME, EMBROIDERY MACHINE, AND METHOD FOR EMBROIDING ENDLESS RIBBONS

(71) Applicant: ZSK Stickmaschinen GmbH, Krefeld (DE)

(72) Inventor: Helmut Stieger, Willich (DE)

(73) Assignee: ZSK Stickmaschinen GmbH, Krefeld (DE)

( * ) Notice: Subject to any disclaimer, the term of this patent is extended or adjusted under 35 U.S.C. 154(b) by 0 days.

(21) Appl. No.: 18/484,488

(22) Filed: Oct. 11, 2023

(65) Prior Publication Data

US 2024/0125027 A1 Apr. 18, 2024

(30) Foreign Application Priority Data

Oct. 13, 2022 (DE) ..... 10 2022 126 769.5

(51) Int. Cl.
*D05C 9/06* (2006.01)
*D05C 3/02* (2006.01)

(52) U.S. Cl.
CPC *D05C 9/06* (2013.01); *D05C 3/02* (2013.01)

(58) Field of Classification Search
CPC ... D05C 9/06; D05C 9/04; D05C 9/10; D05C 9/16; D05C 3/02; D05C 1/02
See application file for complete search history.

(56) References Cited

U.S. PATENT DOCUMENTS 2,358,689 A * 9/1944 Dasher ..... A41D 27/22 112/105
3,182,619 A * 5/1965 Sally ..... D05B 35/102 112/470.07
3,799,086 A * 3/1974 Block ..... D05B 33/00 112/105
5,022,336 A * 6/1991 Iwase ..... B65H 5/16 26/96
6,178,680 B1 * 1/2001 Sloot ..... G09F 21/02 40/668
6,880,471 B2 * 4/2005 Taijima ..... D05B 25/00 112/155
7,357,088 B1 * 4/2008 Bowlus ..... D05C 9/04 112/103
7,930,982 B2 * 4/2011 Surget ..... D05C 9/04 112/103

FOREIGN PATENT DOCUMENTS

DE 230715 A3 12/1985
DE 19923912 A1 11/2000
DE 102005012461 B3 * 7/2006 ..... D05B 75/00
JP 2000248456 A * 9/2000
JP 2002275754 A 9/2002

* cited by examiner

*Primary Examiner* — Ismael Izaguirre
(74) *Attorney, Agent, or Firm* — Smartpat PLC

(57) ABSTRACT

A method for embroidering endless strips using an embroidery machine includes the following steps: Feeding a strip section of at least one upper strip to an embroidery area of an embroidery frame; introducing embroidery using at least one embroidery head onto the strip section of the upper strip within the embroidery area of the embroidery frame; feeding at least one lower strip to the embroidery area of the embroidery frame, which is placed below the upper strip; producing at least one connecting seam between the upper strip and the lower strip in a plane of the embroidery frame; and removing the finished strip comprising the embroidered strip and the lower strip sewn thereto.

9 Claims, 8 Drawing Sheets

EMBROIDERY FRAME, EMBROIDERY MACHINE, AND METHOD FOR EMBROIDING ENDLESS RIBBONS

CROSS-REFERENCE TO RELATED APPLICATION

This application claims the benefit of German Patent Application DE 10 2022 126 769.5, filed on Oct. 13, 2022, the contents of which is incorporated in its entirety.

TECHNICAL FIELD

The present disclosure relates to a method for embroidering endless strips using an embroidery machine.

BACKGROUND

DE 19 923 912 A1 describes a device and a method for embroidering endless strips using an embroidery machine. As a result of the procedure described there, embroidered strips are created, sections of which are embroidered with names of people, for example. Emblems and borders can also be embroidered in addition to the names embroidered in this way in order to achieve special forms of representation of the sections. In the following, for the sake of simplicity, only the term embroidered names is used, but this also refers to the possible design of the sections with other conceivable embroidery such as emblems and borders.

Such embroidered endless strips are separated in a subsequent processing step so that individual strip sections can be handled separately with the names embroidered on them. These strip sections embroidered with names are often used to personalize clothing items such as lab coats or workwear.

If the embroidered strip sections are sewn directly onto the lab coat or workwear, for example in the area of the breast pocket, the lab coat or workwear is assigned specifically to the named person. When washing the lab coats or workwear, this is often undesirable and instead the embroidered strip section is preferably attached to the breast pocket of the lab coat or workwear using an adhesive strip or hook-and-loop fastener strip. This is done by attaching a Velcro (hook) strip to the back of the strip section and a felt (loop) section in the area where the strip attaches to the breast pocket.

If the strip section is embroidered in two layers, i.e., if an upper strip being the visible side and a lower strip which is the hook strip are embroidered together, then the adhesion properties of the hook strip are damaged by the embroidery with the name in such a way that secure adhesion is no longer possible. Accordingly, there is a need to embroider the name on the upper strip in a first step, then to separate the strip sections, and in a further step to connect the upper strip with the lower strip, namely the hook strip, via a circumferential connecting seam. This connecting seam only slightly damages the ability of the Velcro to adhere, thereby ensuring secure adhesion. Nowadays, this stitching together is a process carried out by hand by a sewer and results in finished strip sections.

DD 230 715 A3 discloses an embroidery frame for the continuous embroidery of material strips, by means of which—for example from roll to roll—single or multi-layer material strips are passed through and embroidered, the embroidery frame being constructed to coordinate the movements of several transport rollers and braking of the material strip against the main processing direction.

SUMMARY

The present disclosure is based on the object of eliminating the aforementioned disadvantages. It creates a method that allows an automated sewing together of an upper strip with a lower strip (e.g. a hook strip) by using an embroidery or sewing machine, without damaging the lower strip by embroidery.

The method for embroidering endless strips by an embroidery machine comprises the following steps: feeding a strip section of an upper strip to an embroidery area of an embroidery frame; introducing embroidery, by an embroidery head, onto the strip section of the upper strip within the embroidery area of the embroidery frame (200); feeding a lower strip to the embroidery area of the embroidery frame and placing the lower strip below the upper strip; producing a connecting seam and thereby a finished strip by sewing the upper strip to the lower strip in a plane of the embroidery frame; and removing the finished strip comprising the embroidered strip and the lower strip sewn thereto.

For clarity of description, the present application refers to orientations as shown in the drawings. However, different orientations are possible. The terms "upper" and "lower" may thus be understood the generically refer to "a first" and "a second" element.

A method for embroidering endless strips by an embroidery machine, thus includes: feeding a first strip to an embroidery area of an embroidery frame; guiding a second strip by a feed slider to be selectively arranged next to the first strip in the embroidery area when the feed slider is in a feed position or away from the embroidery area when the feed slider is in a park position; securing the first strip in the embroidery area between an upstream clamp on an inlet side of the embroidery area and a downstream clamp on an outlet side of the embroidery area; introducing embroidery, by an embroidery head, onto the first strip within the embroidery area of the embroidery frame while the feed slider is in the park position and the first strip is secured in the embroidery area; moving the feed slider from the park position to the feed position; sewing the first strip to the second strip while the feed slider is in the feed position; moving the feed slider from the feed position to the park position; releasing the upstream clamp and the downstream clamp; and removing the first strip and the second strip sewn thereto from the embroidery area.

DETAILED DESCRIPTION

Figure 1:
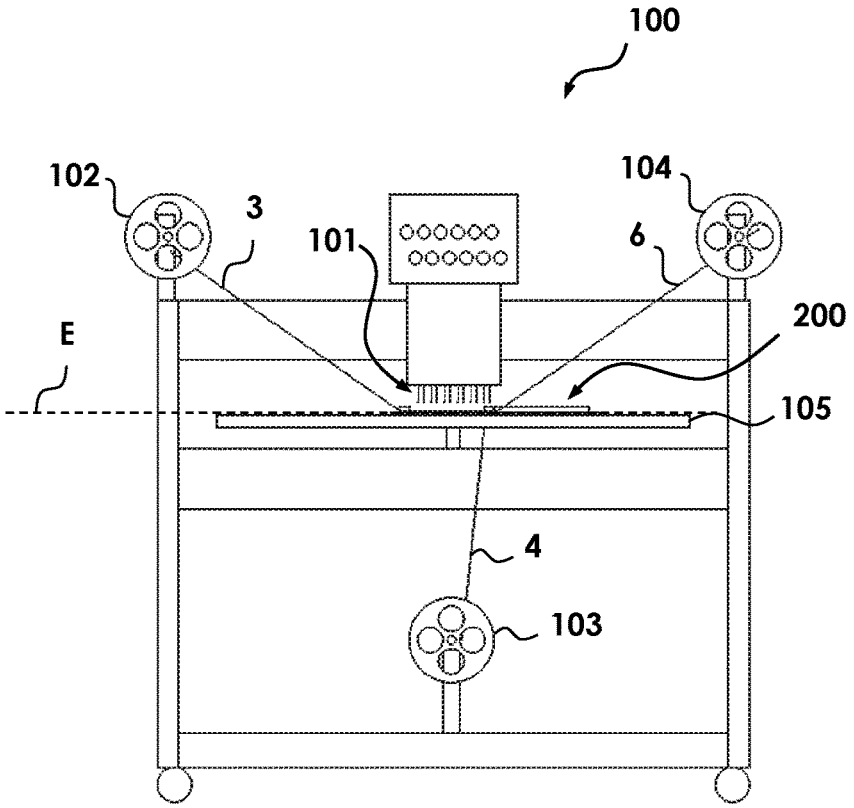
FIG. 1 shows an embroidery machine with an embroidery frame, a feed slider in a park position and an upper strip which is embroidered.

FIG. 1 shows an embroidery machine 100 suitable for embroidering an upper strip 3 and thereafter sewing the upper strip 3 to a lower strip 4. The embroidery machine 100 is used within a method that comprises the following steps:

a) feeding a strip section 30 of at least one upper strip 3 to an embroidery area 207 of an embroidery frame 200;
b) introducing embroidery onto the strip section 30 of the upper strip 3 by means of at least one embroidery head 101 within the embroidery area 207 of the embroidery frame 200;
c) feeding at least one lower strip 4 to the embroidery area 207 of the embroidery frame 200, which is placed below the upper strip 3;
d) producing at least one connecting seam between the upper strip 3 and the lower strip 4 in a plane E of the embroidery frame 200; and
e) removing the finished strip 6 consisting of the embroidered strip 3 and the lower strip 4 sewn thereto.

In a further advantageous embodiment, the following method steps are additionally performed:

a) feeding at least one further upper strip to the embroidery area 207 of the embroidery frame 200, which is placed above the upper strip 3;
b) producing at least one connecting seam between the upper strip 3 and the further upper strip; and
c) removing the finished strip 6 consisting of the embroidered strip 3 and the further upper strip sewn thereto.

As shown in the figures, the lower strip 4 and/or the further upper strip 3' can be guided to the upper strip 3 in the opposite direction ER of the guide direction FR of the upper strip 3 to the embroidery area 207.

Furthermore, it is advantageous that the lower strip 4 and/or the further upper strip 3' is guided to the upper strip 3 by means of at least one feed slider 206 which is displaceable parallel to the plane E of the embroidery frame 200 (FIG. 1).

The feed slider 206 is then used to selectively position the lower strip 4 relative to the upper strip 3. In that case, embroidering the upper strip 3 is performed while the feed slider 206 is in a park position and guides the lower strip 4 to be spaced apart from the embroidery area 207. Feeding the lower strip 4 to the embroidery area 207 is performed by sliding the feed slider 206 from its park position to a feed position, thereby positioning the lower strip 4 such that it abuts the upper strip 3 in the embroidery area 207.

A particularly advantageous embodiment provides that the lower strip 4 and/or the further upper strip 3' and the finished strip 6 are aligned and/or guided with respect to the plane E of the embroidery frame 200 in such a way that the feed slider 206 is positioned by the thrust acting on the feed slider 206 through the lower strip 4 and/or the further upper strip 3' as part of removing the finished strip 6 into its starting position A for repeated feeding of the lower strip 4 and/or further upper strip 3' to the embroidery area 207.

As shown in FIGS. 1 to 8, the embroidery machine 100 further comprises an embroidery frame 200 for embroidering endless strips 1 in a plane E of the embroidery area 207 of the embroidery frame 200 for carrying out a method. The embroidery machine 100 comprises at least one feed slider 206 parallel displaceable to the plane E of the embroidery frame 200, by means of which the lower strip 4 and/or the further upper strip 3' is guided to the upper strip 3.

Figure 12:
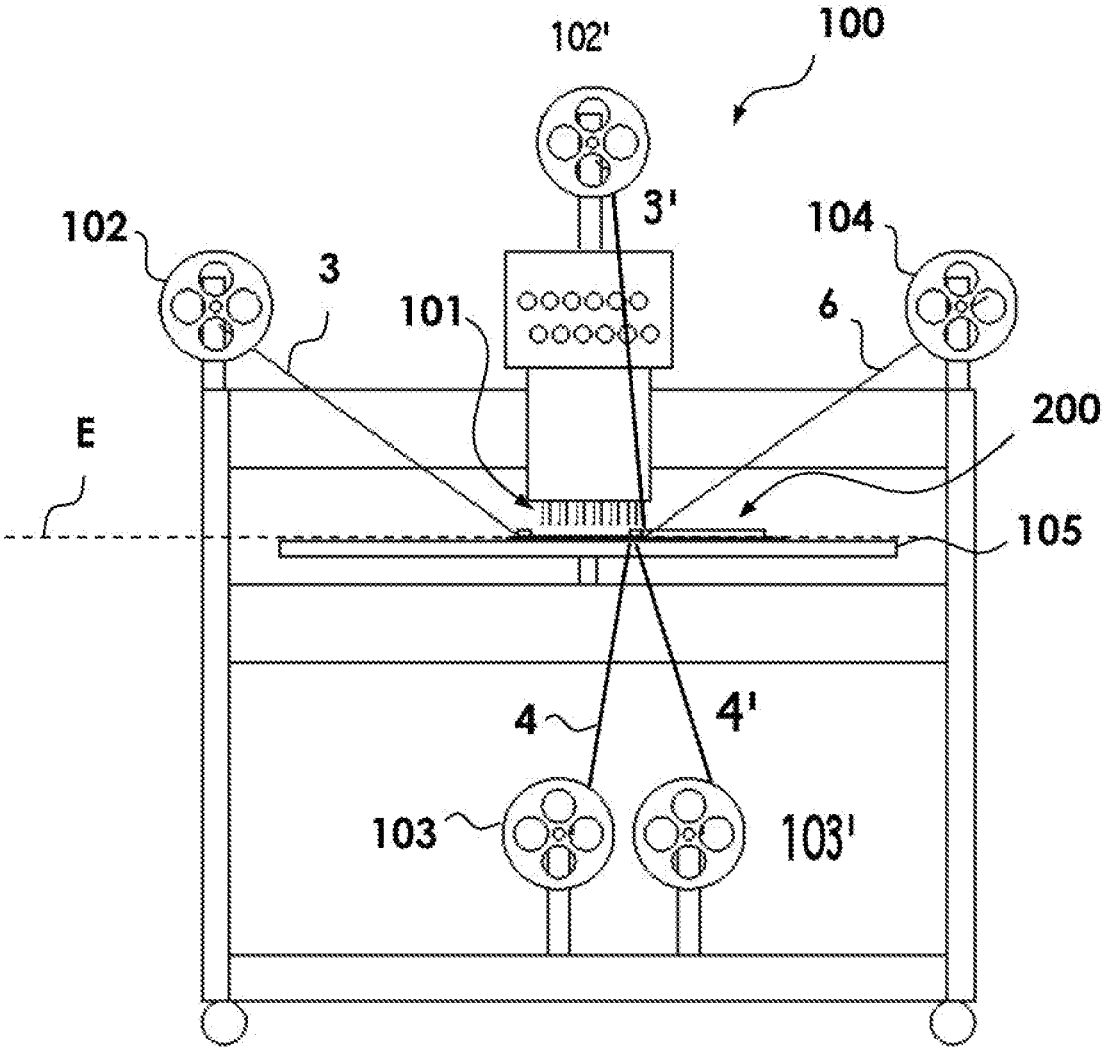
FIG. 12 shows an embroidery machine with an embroidery frame, feed sliders in park positions, an upper strip which is embroidered, and three further strips which a sewn to the upper strip.
Figure 13:
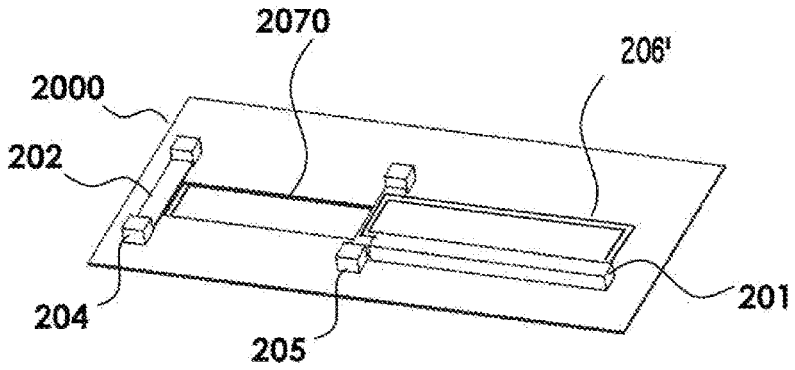
FIG. 13 shows a further embroidery frame in a view from above.
Figure 14:
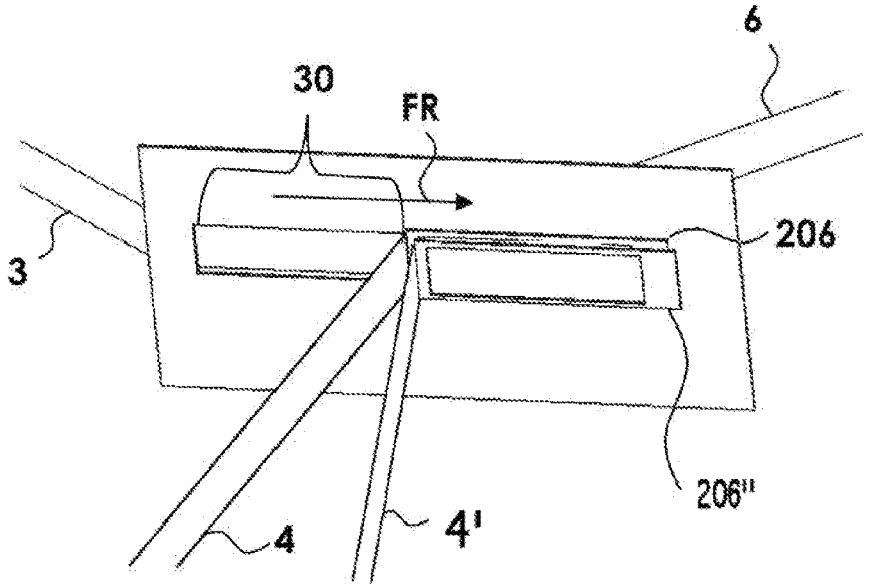
FIG. 14 shows an embroidery frame in a view from below and two feed sliders in park positions.

In a particularly advantageous embodiment as shown in FIGS. 12-14, the embroidery machine 100 comprises a plurality of feed sliders 206 which are displaceable parallel to the plane E of the embroidery frame 200 and by means of which further lower strips 4 and/or further upper strips 3' are successively fed above and/or below the upper strip 3 and for the purpose of sewing the strips for further embroidering of the strips.

The embroidery frame 200 can advantageously include a base plate 2000 for receiving and/or forming the embroidery frame 200, in which at least one cutout 2070 is provided for forming the embroidery area 207, such that the upper strip 3 to be embroidered extends from one side to the other side or is guided through this cutout 2070 in order to be embroidered using the embroidery head 101 of the embroidery machine.

At least one holding, fixing and/or clamping means 202, 203 and at least one associated drive element 204*a*, 204*b*, 205*a*, 205*b* for the upper strip 3 are preferably provided on at least one side of the embroidery area 207.

The feed slider 206 can preferably include at least one drive 201.

As shown in FIGS. 1 to 8, an embroidery machine for embroidering endless strips 1 in a plane E of the embroidery area 207 of an embroidery frame 200 for carrying out a method has at least one unwinding roller 102 for the upper strip 3, at least an unwinding roller 103 for the lower strip 4 and further at least one winding roller 104 for the finished strip 6.

In a further embodiment, the embroidery machine 100 preferably comprises at least one control, by means of which the embroidery frame 200 is moved on or on top of a plate 105 of the embroidery machine 100 in the X and Y directions in the course of the embroidery and sewing process in such a way that the embroidery head 101 creates an embroidery on the upper strip 3.

Figure 9:
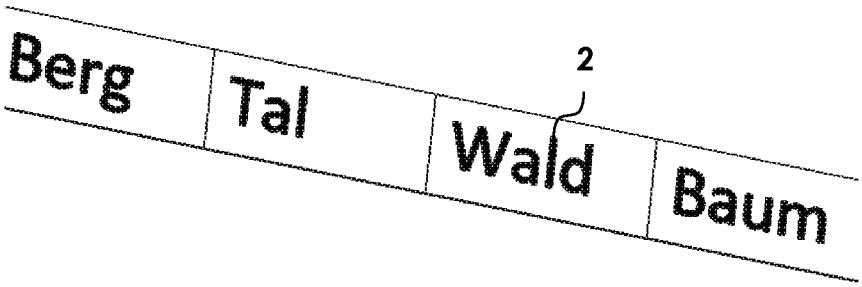
FIG. 9 embroidered names on an endless strip.
Figure 10:
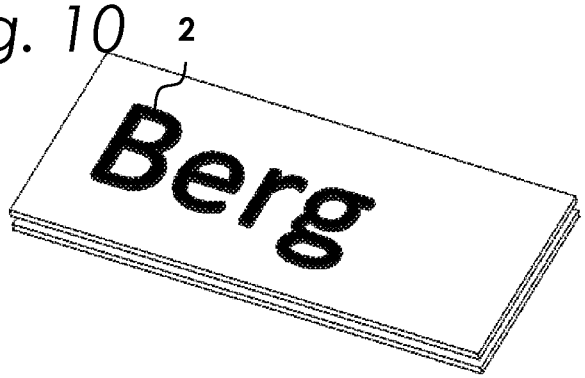
FIG. 10 shows a strip section with an embroidered name backed by a hook strip.
Figure 11:
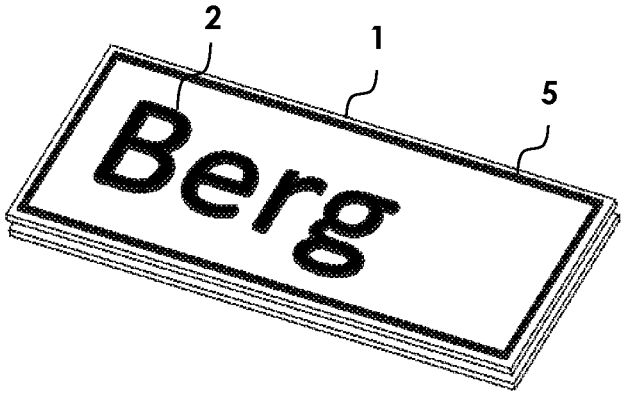
FIG. 11 shows a finished strip section with an embroidered name, backed by a hook strip and circumferential connecting seam.

FIG. 9 shows an endless strip 1, which is embroidered in sections with names 2. On the other hand, a single strip section is shown in FIG. 11, which consists of a visible upper strip 3, the embroidered name 2 and the lower backing strip 4, namely preferably a hook strip. The connection of the upper strip 3 to the lower strip 4 is advantageously produced by a circumferential connecting seam 5. Accordingly, the embroidered strip 6 sewn with the circumferential connecting seam is shown in FIG. 11.

The process is automated with the embroidery frame 200 on an embroidery or sewing machine. For this purpose, the embroidery machine 100 with the selective embroidery frame 200 is shown in FIG. 1. This (selective) embroidery frame 200 rests on the plate 105 of the embroidery machine 100 and is moved by the control of the embroidery machine in the X and Y directions in the course of the embroidery and sewing process in such a way that the embroidery is introduced by means of the embroidery head 101 and the free arm 107 and thereby the name to be embroidered on strip 3 is created.

The embroidery machine 100 is preferably a free arm embroidery machine and accordingly has a free arm 107. This free arm ensures that the bobbin thread gripper required for the embroidery process is freely accessible from the front and side. This design of the embroidery machine 100 is comparable to the design of a free arm sewing machine. The required free access from the front and side can also be achieved using other designs in the area of the bobbin thread gripper.

Furthermore, the unwinding roller 102 for the upper strip 3 and the unwinding roller 103 for the lower strip 4 are shown in FIG. 1. These unwinding rollers 102, 103 can be designed as freewheeling or driven rollers. The winding roller 104 serves to receive the finished strip 6 sewn according to the invention and advantageously has a drive unit.

Figure 2:
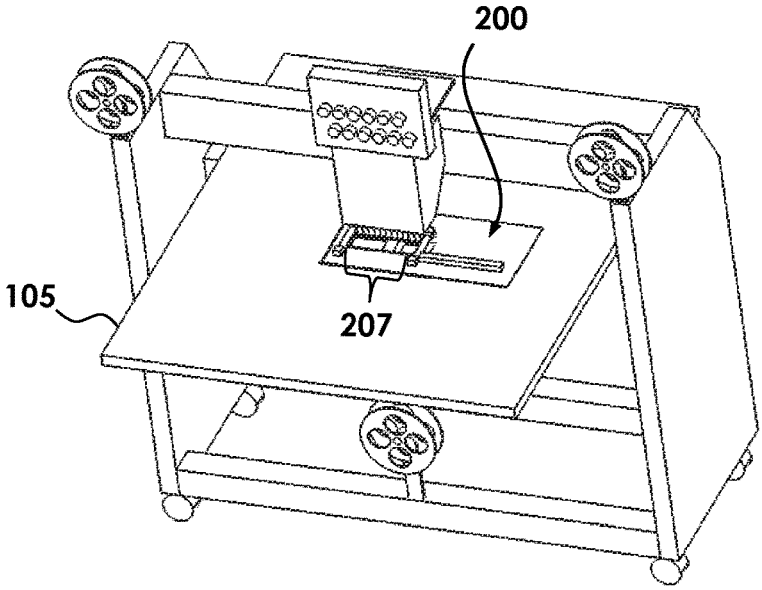
FIG. 2 shows an embroidery machine with a selective embroidery frame.
Figure 3:
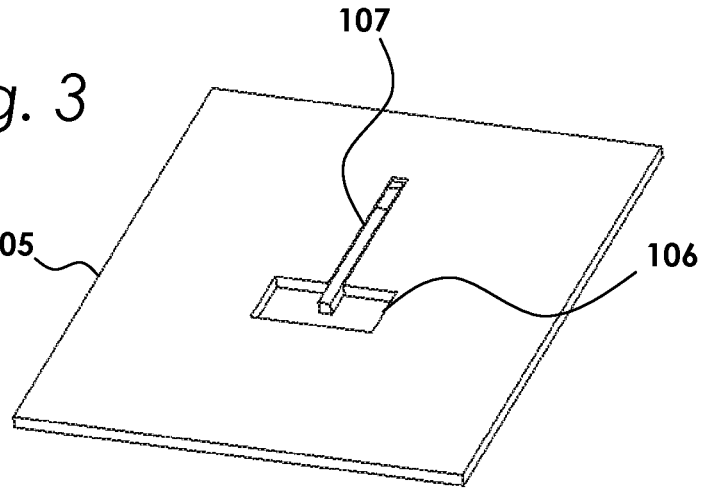
FIG. 3 shows a plate of the embroidery machine with a cutout and free arm.

FIGS. 2 and 3 show details of the plate 105 of the embroidery machine 100. Free access to the free arm 107 from the front and side is achieved via the cutout 106 in the plate 105.

Figure 4:
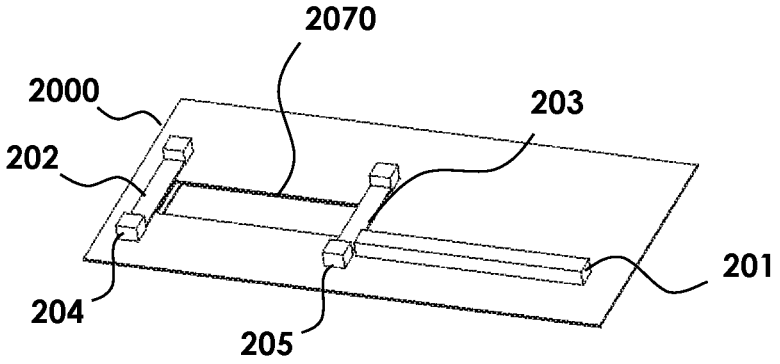
FIG. 4 shows an embroidery frame in a view from above.
Figure 6:
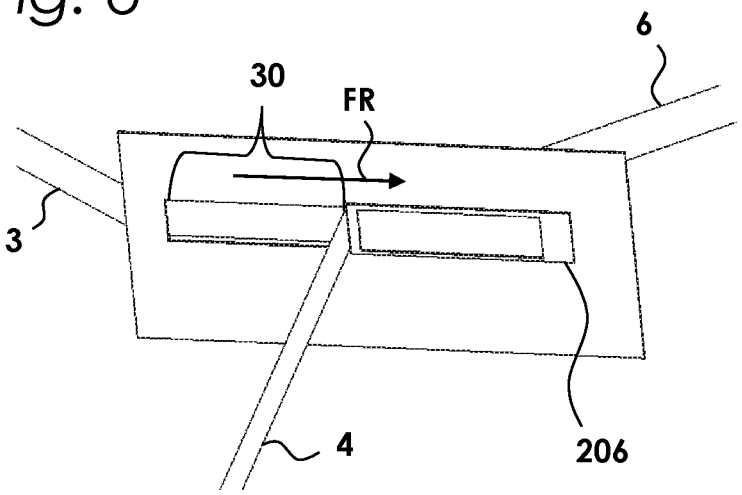
FIG. 6 shows an embroidery frame in a view from below and a feed slider in the park position.

FIG. 4 shows the structure of the embroidery frame 200 according to the invention in a view from above. The base plate 2000 of the embroidery frame 200 has a cutout 2070 such that the strip 3 to be embroidered is guided from one side to the other side through this cutout 2070 in order to be embroidered by means of the embroidery head 101 of the embroidery machine 100. The holding, fixing and/or clamping means 202 for the upper strip with the associated drive elements 204*a* and 204*b* is mounted on the base plate 2000 of the embroidery frame 200. On the other side of the cutout 2070, the holding, fixing and/or clamping means 203 for the sewn strip is mounted with the drive elements 205*a* and 205*b*. The drive 201 is used to move the feed slider 206 according to the invention on the underside of the embroidery frame as shown in FIG. 6.

Figure 5A:
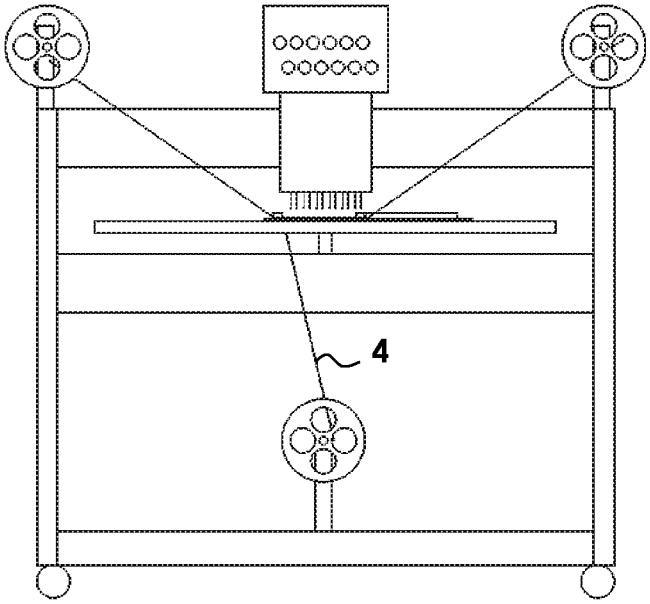
FIG. 5*a* shows an embroidery machine with an embroidery frame, a feed slider in a feed position, and an upper strip that is sewn to a lower strip.
Figure 5B:
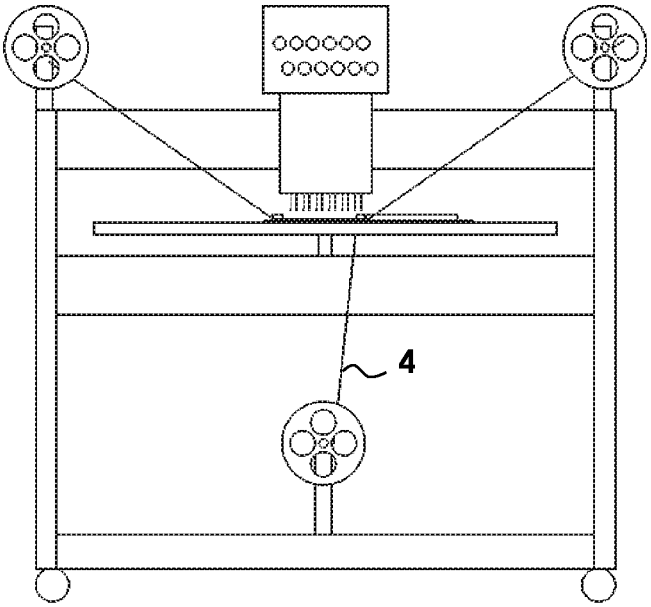
FIG. 5*b* shows an embroidery machine as in FIG. 5*a* with a feed slider in a park position.

FIG. 5*b* shows the embroidery machine 100 with embroidery frame 200 in the front view and the park position of the feed slider 206 for embroidering the upper strip. The course of the upper strip 3 from the unwinding roller 102 for the upper strip is arranged here to the left of the embroidery frame 200. The feeding of the lower strip 4 from the unwinding roller 103 is also shown. Due to the feed slider 206 being in a park position shown on the right, the lower strip 4 is arranged on a downstream (right) side of the free arm 107 and is not embroidered with the name in this phase. The guidance of the finished embroidered and sewn finished strip 6 from the embroidery frame 200 to the winding roller 104 for the sewn finished strip 6 can be seen on the right above the plate 105.

In contrast, FIG. 5*a* shows the embroidery machine 100 with embroidery frame 200 in the second phase of processing. The feed slider 206 is in the feed position on the left side and the lower strip 4 is inserted into the cutout 2070 and therefore to the left of the free arm 107. As a result, in this second phase of processing, the upper strip 3, which has already been embroidered with the name, is sewn to the lower strip 4, which is placed under the upper strip 3, using the circumferential connecting seam 5.

Figure 7:
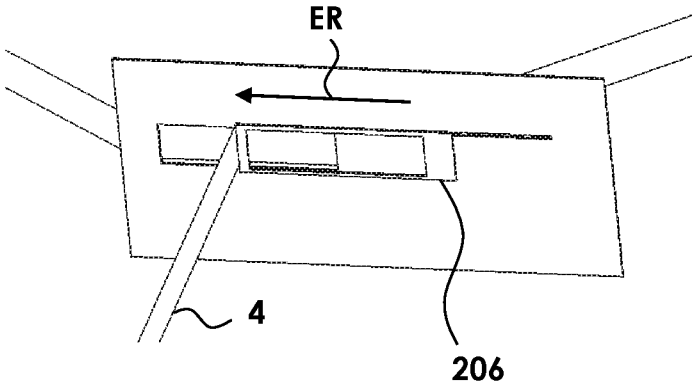
FIG. 7 an embroidery frame in a view from below and a feed slider in motion from the park position to the feed position.
Figure 8:
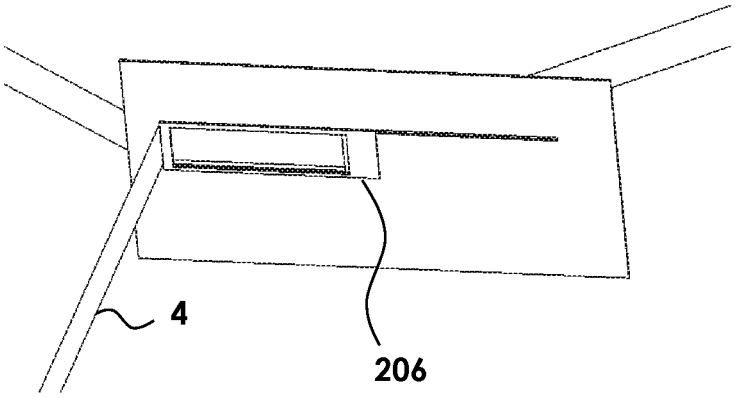
FIG. 8: an embroidery frame in a view from below and a feed slider in the feed position.

The FIGS. 6, 7, 8, which show the embroidery frame 200 in a view from below, serve to illustrate the positions of the feed slider 206 with the strip in different positions of the feed slider 206. In FIG. 6 the feed slider 206 is shown in the park position. Accordingly, the lower strip 4 is on the right side, as can be seen in the front view in FIG. 4. Therefore, in this phase only the upper strip 3 lies in the cutout 2070 of the embroidery frame 200. Only the upper strip 3 is under the embroidery head 101 and is embroidered with the name in this first phase. After the embroidery of the upper strip 3 with the name has ended, the feed slider 206 is moved to the feed position by activating the drive 201 for the feed slider 206. The lower strip 4 is inserted under the upper strip 3 in the cutout 2070. FIG. 8 shows the feed slider 206 in the feed position. As a result, the lower strip 4 is completely arranged under the upper strip 3 in the cutout 2070. The lower strip 4 is on the feed side of the free arm 107 as can be seen in the front view in FIG. 5*a*. In this arrangement of the two strips 3 and 4 one above the other and abutting one another, the circumferential connecting seam 5 is sewn by means of the embroidery head 101 in the second phase of processing. At the end of the second phase after completion of the circumferential connecting seam 5, the feed slider 206 moves to the right into its park position and thereby releases the lower strip 4 again.

The functionality of the invention will be explained in more detail below using a process sequence. Process step a) is used to produce the starting state. For this purpose, the selective embroidery frame 200 is in the X/Y starting position such that the cutout 2070 is arranged in front of the free arm 107 in the area of the cutout 106. The upper strip 3 is guided from the unwinding roller 102 for the upper strip to the top of the embroidery frame 200 and, with the left clamp 202 open, is guided from left to right to the also open right clamp 203 over the cutout 2070. In this starting state, the feed slider 206 is in its park position. From the lower unwinding roller 103 the lower strip 4 is brought together with the upper strip from the bottom through the right clamp 203. This means that the lower strip 4 is to the right of the free arm 107. From the right clamp 203, the upper and lower strips are guided together to the winding roller 104 and fastened thereon. The clamps 202 and 203 are closed by means of the drives 204 and 205, respectively. The upper strip 3, the lower strip 4 and the brought together strips 6 are then relaxed, so that a slack is created in each case, which allows the selective embroidery frame 200 to move in the X and Y directions.

In method step b), the embroidery frame 200 moves in the Y direction under the embroidery head 101 in such a way that the strip, which is inserted in the cutout 2070, can be embroidered. Due to the preparation in processing step a, only the upper strip 3 is in the cutout 2070 for embroidery. The lower strip 4 is downstream of the free arm 107 and therefore cannot be embroidered in the first phase.

The upper strip 3 is embroidered with the name in processing step b) and ends in processing step d. In processing step e, the selective embroidery frame moves into the front X/Y position such that the cutout 2070 is arranged in front of the free arm 107 in the area of the cutout 106.

The feed slider 206 moves in method step c)—driven by the drive 201—from its park position to its feed position. The lower strip 4 is moved under the upper strip 3 in the cutout 2070. Thereby, the lower strip 4 is to the feed side of the free arm 107.

The embroidery frame 200 then moves in the Y direction under the embroidery head 101. In the following process step d), the circumferential connecting seam 5 between the upper strip 3 and the lower strip 4 is produced using the embroidery head 101. After completion of the circumferential connecting seam 5, the selective embroidery frame moves back to its X/Y starting position. The feed slider 206 moves into its park position, driven by the drive 201, and releases the sewn strip 6.

In the next processing step e), the holding, fixing and/or clamping means 202 and 203 are released. The embroidered and sewn strip 6 is conveyed and wound up from the area of the cutout 2070 by activating the winding roller 104. During this process, a new section of the upper strip 3 and the lower strip 4 are pulled in at the same time. Thereby, the lower strip 4 is on the downstream side of the free arm. The holding, fixing and/or clamping means 202 and 203 are closed by means of the drives 204 and 205, respectively. The upper strip 3, the lower strip 4 and the sewn finished strip 6 are then relaxed, so that a slack forms in each case, which allows the embroidery frame 200 to move in the X and Y directions. Through the transition to process step b), the next embroidery process of the next strip section is started cyclically.

An advantage of the embroidery machine 100 is that an automated process is made possible. In addition, the clamping of the upper strip remains in place throughout the two phases, so that a high level of precision is achieved when creating the circumferential connecting seam 5.

As shown in FIGS. 12-14, the embroidery machine 100 can be expanded by additional feed sliders 206 on the underside of the embroidery frame 200 in such a way that not only two strips can be embroidered or sewn together in different phases, but also several strips beyond that. The present invention can be reversed in such a way that the additional strips are fed from a position above the embroidery frame 200 and thus the additional strips are inserted above the upper strip 3.

LIST OF REFERENCE NUMBERS

1 endless strip
2 embroidered names
3 upper strip
4 lower strip (hook strip, Velcro strip)
5 circumferential connecting seam
6 sewn finished strip
30 strip section
100 embroidery machine
101 embroidery head
102 unwinding roller for upper strip material
103 unwinding roller for lower strip material
104 winding roller for sewn strip material
105 plate
106 cutout in plate
107 free arm
200 embroidery frame
201 slider drive
202 left clamp upper strip material
203 right clamp sewn strip material
204 drive left clamp upper strip material
205 drive right clamp sewn strip material
206 feed slider (slider)
207 embroidery area
2000 base plate of the embroidery frame
2070 cutout in the base plate of the embroidery frame
E plane of the embroidery frame
ER opposite direction to the guide direction
FR guide direction

What is claimed is:

1. A method for embroidering endless strips (1) by an embroidery machine, comprising:

feeding a strip section (30) of an upper strip (3) to an embroidery area (207) of an embroidery frame (200);

introducing embroidery, by an embroidery head (101), onto the strip section (30) of the upper strip (3) within the embroidery area (207) of the embroidery frame (200);

feeding a lower strip (4) to the embroidery area (207) of the embroidery frame (200) and placing the lower strip (4) below the upper strip (3);

producing a connecting seam and thereby a finished strip (6) by sewing the upper strip (3) to the lower strip (4) in a plane (E) of the embroidery frame (200); and removing the finished strip (6) comprising the embroidered strip (3) and the lower strip (4) sewn thereto.

2. The method according to claim 1, wherein the lower strip (4) is guided to the upper strip (3) in an opposite direction (ER) of a guide direction (FR) of the upper strip (3) to the embroidery area (207).

3. The method according to claim 2, wherein the lower strip (4) is guided to the upper strip (3) by a feed slider (206) which is displaceable parallel to the plane (E) of the embroidery frame (200).

4. The method according to claim 3, wherein the lower strip (4) and the finished strip (6) are aligned and guided with respect to the plane (E) of the embroidery frame (200) such that the feed slider (206) is positioned by a thrust acting on the feed slider (206) through the lower strip (4) as part of removing the finished strip (6) into a starting position (A) of the feed slider (206) for repeated feeding of the lower strip (4) to the embroidery area (207).

5. An embroidery frame (200) for an embroidery machine for embroidering endless strips (1) in a plane (E) of an embroidery area (207) of the embroidery frame (200), comprising:

a feed slider (206) which is displaceable parallel to a plane (E) of the embroidery frame (200), by which a lower strip (4) is guided to an upper strip (3); and a further feed slider (206') which is displaceable parallel to the plane (E) of the embroidery frame (200) and by which a further lower strip (4') is placed below the upper strip (3).

6. The embroidery frame (200) according to claim 5, wherein a clamp (202, 203) and an associated drive (204*a*, 204*b*, 205*a*, 205*b*) for the upper strip (3) are provided on at least one side of the embroidery area (207).

7. The embroidery frame (200) according to one of claim 5, wherein the feed slider (206) comprises a drive (201).

8. An embroidery machine (100), comprising:

the embroidery frame according to claim 5;

an unwinding roller (102) for the upper strip (3);

an unwinding roller (103) for the lower strip (4); and a winding roller (104) for a finished strip (6).

9. A method for embroidering endless strips (1) by an embroidery machine, comprising:

feeding a first strip (3) to an embroidery area (207) of an embroidery frame (200);

guiding a second strip (3',4,4') by a feed slider (206) to be selectively arranged next to the first strip (3) in the embroidery area (207) when the feed slider (206) is in a feed position or away from the embroidery area (207) when the feed slider (206) is in a park position;

securing the first strip (3) in the embroidery area (207) between an upstream clamp (202) on an inlet side of the embroidery area (207) and a downstream clamp (203) on an outlet side of the embroidery area (207);

introducing embroidery, by an embroidery head (101), onto the first strip (3) within the embroidery area (207) of the embroidery frame (200) while the feed slider (206) is in the park position and the first strip (3) is secured in the embroidery area (207);

moving the feed slider (206) from the park position to the feed position;

sewing the first strip (3) to the second strip (3',4,4') while the feed slider (206) is in the feed position;

moving the feed slider (206) from the feed position to the park position;

releasing the upstream clamp (202) and the downstream clamp (203); and removing the first strip (3) and the second strip (4) sewn thereto from the embroidery area (207).

* * * * *